United States Patent [19]

Carter

[11] 4,316,560

[45] Feb. 23, 1982

[54] PAINT CAN DISPENSING RING ATTACHMENT

[76] Inventor: Richard T. Carter, 13 Spring Hill, Mont Vernon, N.H. 03057

[21] Appl. No.: 972,951

[22] Filed: Dec. 26, 1978

Related U.S. Application Data

[63] Continuation-in-part of Ser. No. 704,746, Jul. 12, 1976, abandoned.

[51] Int. Cl.[3] ..... B65D 25/48

[52] U.S. Cl. ..... 222/567; 220/85 SP

[58] Field of Search ..... 222/567, 569, 571, 573, 222/575; 141/337; 220/85 SP, 90

[56] References Cited

U.S. PATENT DOCUMENTS

| | | | |
|---|---|---|---|
| 2,315,250 | 3/1943 | Eilers | 222/567 |
| 2,688,418 | 9/1954 | Carter | 222/567 X |
| 2,731,178 | 1/1956 | Larsson | 222/567 |
| 3,090,531 | 5/1963 | Weaver et al. | 222/569 X |
| 3,093,273 | 6/1963 | Borah | 222/569 X |
| 3,252,635 | 5/1966 | Rosenhan | 220/90 X |
| 3,272,395 | 9/1966 | Lawyer | 220/90 UX |
| 3,273,746 | 9/1966 | Andrews, Jr. | 220/90 |
| 3,309,000 | 3/1967 | Haverstick | 222/570 X |
| 3,356,266 | 12/1967 | Pinter, Jr. | 222/569 X |
| 3,428,213 | 2/1969 | Stephens | 141/337 X |
| 3,727,792 | 4/1973 | Levin | 220/90 |
| 3,972,453 | 8/1976 | Kapples | 222/570 X |

*Primary Examiner*—Robert J. Spar
*Assistant Examiner*—Edward M. Wacyra

[57] ABSTRACT

The conventional paint can is provided with a dispensing ring which protects the sealing groove and sides of the can from contamination with paint. The dispensing ring comprises a conical lip adapted to extend radially over the can sidewall and terminates inwardly with a downwardly extending conical skirt for compressive engagement by the innermost edge of the can opening.

1 Claim, 5 Drawing Figures

PAINT CAN DISPENSING RING ATTACHMENT

This application is a continuation-in-part of application Ser. No: 704,746. filed on July 12, 1976, now abandoned.

The cylindrical metal container or can for liquids such as paints and stains has become highly developed in design, changing little over the years due to excellence in performance and general simplicity in construction. However, these cans are lacking in satisfactory performance when the contents must be dispensed. It is impossible to dispense the contents of a full can without coating the sidewall of the can and filling the can lid sealing groove. This causes waste and difficult clean-up operations. Similarly, if one is working directly out of the can with a paint brush and using the inner rim of the can to control the amount of paint withdrawn, filling of the sealing groove becomes inevitable.

Several inventions have been proposed to overcome these disadvantages, but these ideas have not proved satisfactory since they have only been operative with one size of can rim. Although the conventional can has a fixed and consistant capacity, the actual contour of the sealing ring is a matter of individual manufacturing preference, and the innermost rim of the can may vary considerably in diameter.

It is a main object of the invention to provide a removable dispensing ring for cylindrical cans which will compressively and frictionally engage within the can opening, and will successfully protect the sealing ring groove and the outside surface of the can wall from contamination with the contents when dispensing the same.

It is a further object of the invention to provide a paint can dispensing ring for insertion into an open can to enable paint to be withdrawn by brush or other means without danger of the can contents filling the exposed sealing ring groove or contaminating the outside surface of the can.

Yet another object of the invention is to provide a paint can dispensing ring which is disposable and may be attached to an open can to accurately dispense paint without spillage, and to incorporate such design as is necessary for manufacture at minimum cost and thereby provide a disposable item to solve the need and provide the advantages outlined above.

The invention briefly consists of a conical lip portion which extends outwardly over the exposed seal ring groove of a cylindrical paint can and terminates beyond the vertical sidewall of the can. The conical lip communicates inwardly with a downwardly extending conical skirt which frictionally engages with the innermost rim of the open can. The conical skirt provides a friction tight fit with the rim edge, regardless of the variation in the diameter commonly found on this hitherto nonfunctional edge.

The invention will be more completely understood in the following more detailed description of preferred embodiments thereof, when taken in conjunction with the attached drawings wherein.

Figure 3:
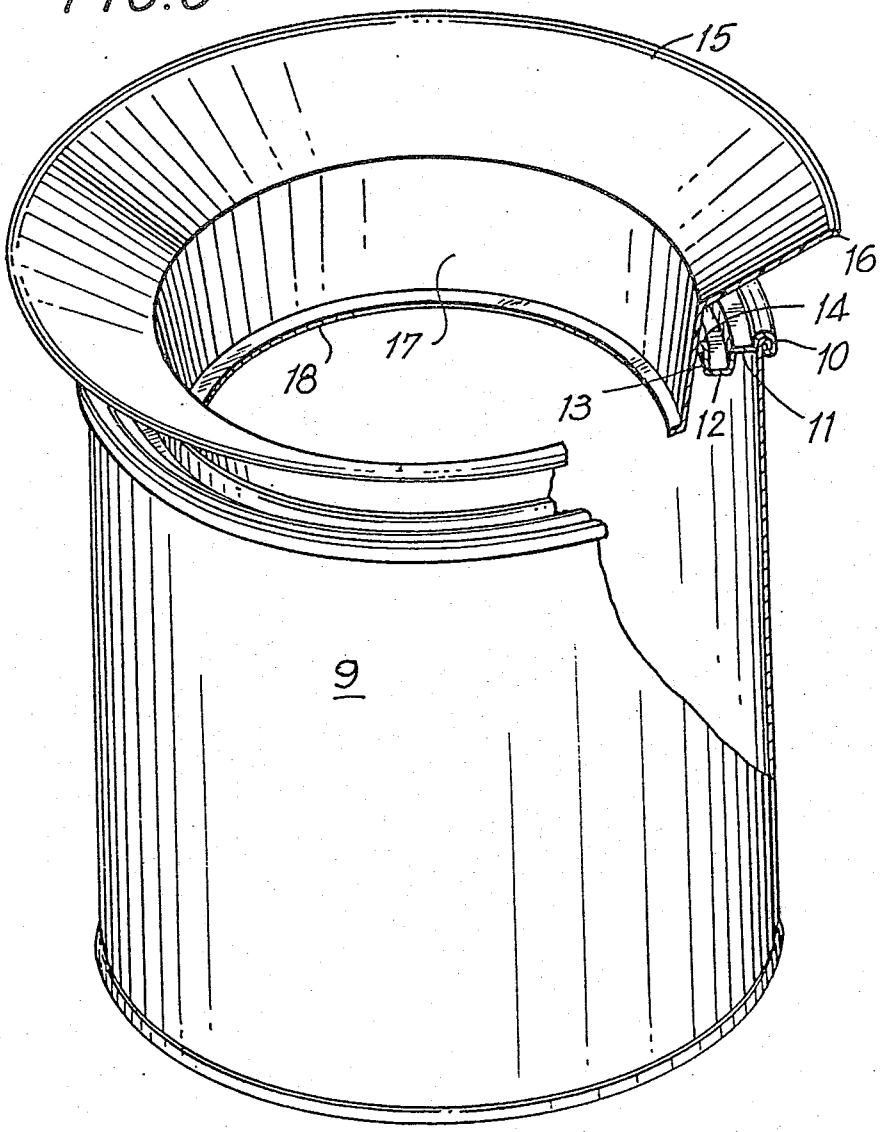
FIG. 3 is a perspective view of the invention placed in operative frictional engagement with the open end of a paint can, and shown partly broken away and in cross section to show the engagement with the inner rim of the can opening.

Referring now to the drawings, the numeral 9 represents the cylindrical sidewall of a conventional sealable container or paint can. The wall 9 terminates with a peripheral bead 10 which connects with an inwardly extending lid sealing ring 11. The ring 11 includes an annular channel 12 which terminates with an upwardly extending inner wall 13 which is capped by an annular rolled rim 14 to form the innermost contour of the can opening, as is common practice.

Figure 1:
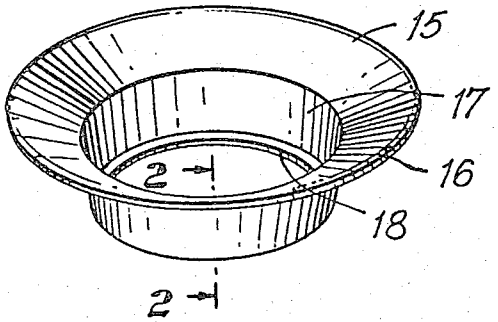
FIG. 1 is a perspective view of the dispensing ring attachment which comprises my invention.
Figure 2:
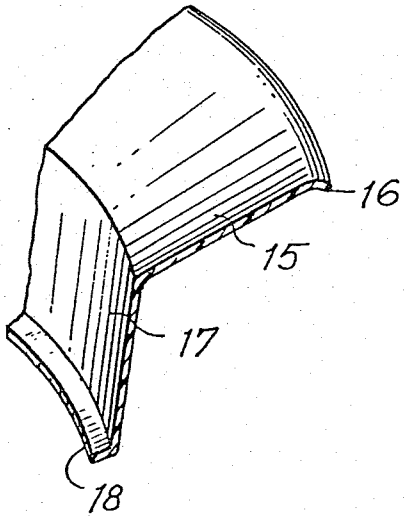
FIG. 2 is a fragmentaary cross sectional view of the invention taken along the line 2—2 of FIG. 1.

The dispensing ring attachment is of unitary construction and is shown in FIGS. 1 and 2. The attachment comprises a circumferentially disposed conical pouring lip 15 which is turned downwardly at the outer peripheral edge at 16 to provide a suitable dispensing contour throughout the circumference. The lip is further defined as forming an outwardly and upwardly extending conical surface with respect to the plane formed by the sealing ring 11, and terminates beyond the can wall 9 so as to overlap the entire circumference of the annular channel 12 to provide for adequate inwardly directed paint drainage, and to form a suitable resting platform for the handle and brush structure of a typical paint brush. The lip communicates inwardly with a thin and linear downwardly extending conical skirt 17. The surface of the skirt may be textured on its outer side but is essentially smooth and linear in contour so as to provide for compressive and frictional engagement with the inner side of the rolled rim 14. The diameter of the skirt reduces progressively in order to form the conical shape which enables a liquid tight seal to be formed with the can rim.

For added peripheral reinforcement, the skirt 17 may terminate at its lower extremity with an inwardly directed annular collar 18. This collar enables skirts of thinner section to be formed, and at the same time provides a convenient scraping edge for use with a paint brush, replacing the can rim which is currently normally used for this purpose. It should be made of note that both internal and external cylindrical surfaces of the collar are concentric and of necessity are both smaller than the diameter of the can rim.

The frictional sealing of the skirt in the can rim warrents further discussion and explanation. Plastic materials such as polyethylene, polypropylene, and latex modified polystyrene are suitable materials for making a part of this kind. The compression modulus of these materials is in the order of $1\text{–}6\times10^5$ lbs/in$^2$ which means that using hand applied forces they are vertually incompressible. The forces involved in pressing a conical skirt into a circular opening are translated into a circumferential loading of material compression. The compression of the skirt even by a very small amount requires considerable loading which cannot be accomplished by hand unless the taper is very gradual. Further, unless compression is established the loaded skirt will not form a seat for the rim to locally cancel the taper and overcome the tendency for the skirt to slide on the paint lubricated rim of the can.

Extensive tests have been carried out with many of the common plastic materials, and it has been found that the sealing of a thin conical sleeve or skirt by hand loading can only be accomplished in a range of taper reaching a maximum of about 10 degrees between the perpendicular or central axis of the can and the plane of the can opening. The precise taper depends on the frictional properties of the material, and the texture of the molded or otherwise formed skirt surface. By way of example about 5 degrees is found to be satisfactory with latex modified polystyrene. A taper of less than 2 degrees becomes impractical because of the extensive depth of skirt which would be required.

The size of a one gallon paint can is substantially standardized with respect to the outside diameter and height, but the seal rim diameter is non-functional and is found to vary in size from one manufacturer to another depending on the precise choice of seal rim contour and whether the lid seal is designed for heavy or light sealing pressures. In consequence it is important to present the same precise taper angle to the seal rim regardless of its diameter so that the same secure frictional fit may be assured.

A study of can sizes from fourteen of the major manufacturers of paint cans has been made and a summary of the sizes and tolerances is listed below:

| DIMENSION | ONE GALLON SIZE | ONE QUART SIZE |
|---|---|---|
| Median Reading | 5.514 | 3.271 |
| High Reading | 5.582 | 3.370 |
| Low reading | 5.457 | 3.160 |
| 2-Sigma | ±0.0606 | ±0.132 |
| Maximum variation | 0.125 | 0.210 |

From the above it is determined that if the skirt is formed long enough so that the diameters embrace both upper and lower readings, then the device will fit all currently manufactured cans at a confidence level of 95%.

Figure 4:
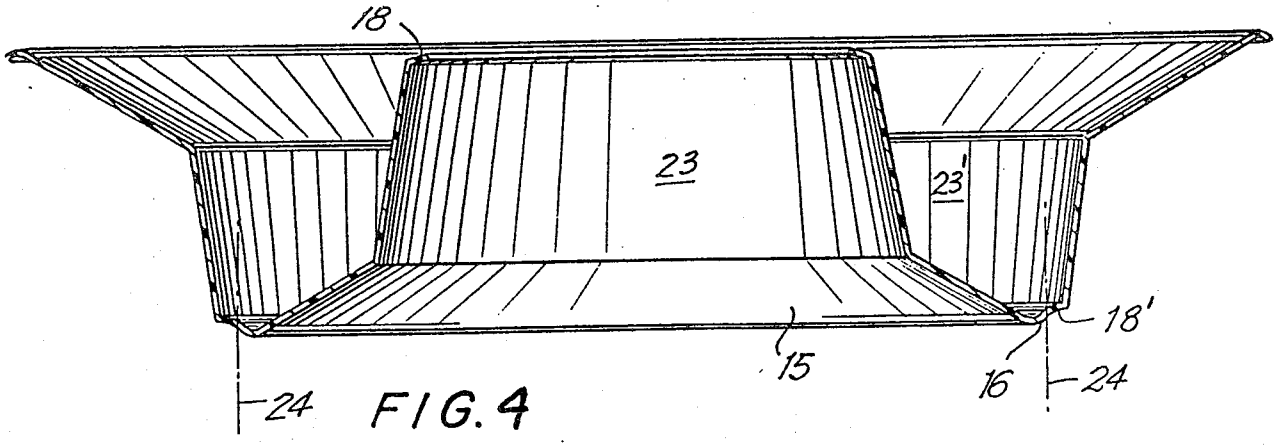
FIG. 4 is a cross sectional view taken through the diameter of the ring attachment and representing one molded embodiment showing how a one quart and a one gallon attachment ring may be formed simultaneously.
Figure 5:
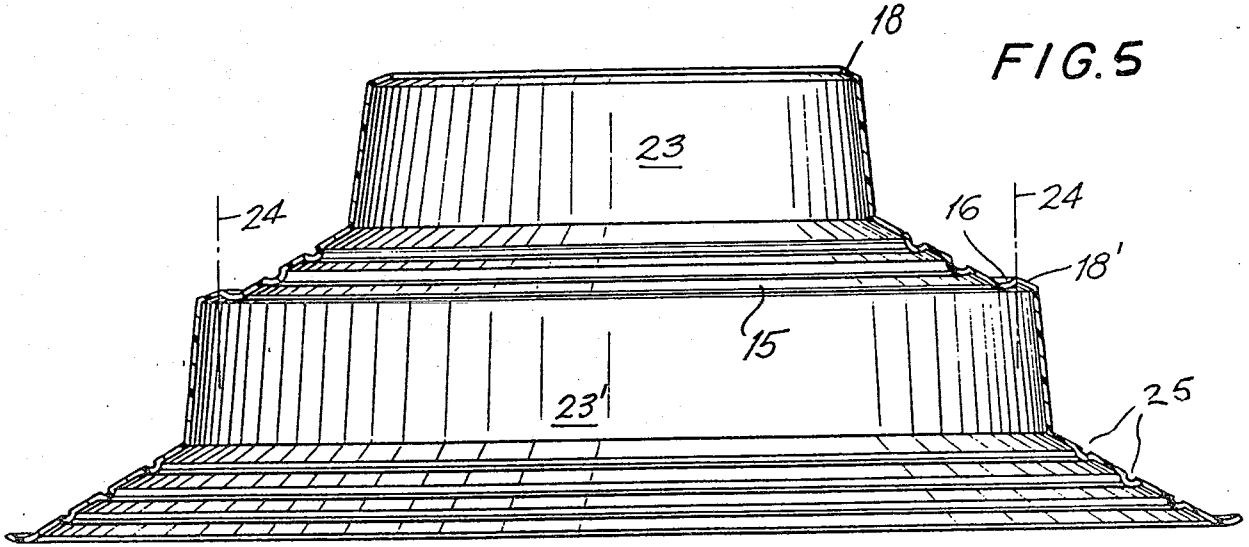
FIG. 5 is a cross sectional view similar to FIG. 4 showing an alternate molding form.

FIGS. 4 and 5 disclose two economical ways of making both the one gallon and one quart size can dispensing ring attachment in one die and in one injection or forming operation. In FIG. 4, the smaller attachment ring 23, intended for a one quart capacity can, is shown in an inverted position. This ring has a lip 16 which terminates peripherally with a partially sheared break-away connection indicated at the intersection of the broken line 24 with the lip. The connection communicates with the inner edge of a collar 18' of a one gallon size attachment ring 23' shown in the upright position. FIG. 5 shows the two dispensing rings in a stacked orientation with a similar break-away parting situation. It will be noted that the inner collar of the small ring provides an ideal location for multi-point radial injection gates for simple feeding of the two parts. Annular grooves 25 are shown formed symetrically in the pouring lip portion of the dispensing rings, see FIG. 5. These ring grooves provide improved rigidity of the device when in use.

While the embodiment of the invention has been carefully illustrated and described, it will be understood that various changes and modifications may be made without departing from the scope or spirit of the invention as defined in the following claims.

I claim:

1. A dispensing ring attachment for a container having a circular opening defined by a sealing rim communicating with the peripheral wall of the container, said attachment being of unitary construction and comprising a circumferentially extending pouring lip issuing from said opening outwardly over said rim and the peripheral wall of the container, said lip terminating with a downwardly turned peripheral edge and communicating inwardly with a downwardly and inwardly tapering thin conical skirt of constant thickness adapted to compressively engage with and provide a continuous liquid tight seal against the sealing rim of the container, said thin conical skirt being circumferentially compressed by engagement with the said rim to form a temporary depressed seat locally changing the contour of both sides of the skirt, said inwardly tapering skirt being disposed at a tapering angle to the plane of said sealing rim in the range of 2 to 10 degrees, and maintaining substantially the same taper both above and below said rim after insertion therewithin, said skirt terminating at its lowermost extremity with an annular collar defined by concentric inner and outer surfaces both smaller in diameter than the sealing rim of the can.

* * * * *